US008959752B2

(12) United States Patent
Ikeda et al.

(10) Patent No.: US 8,959,752 B2
(45) Date of Patent: Feb. 24, 2015

(54) TRANSFORMER CORE MANUFACTURING APPARATUS AND METHOD

(75) Inventors: Shunsuke Ikeda, Sekikawa (JP); Junichi Ishizuki, Tainai (JP); Takashi Kurata, Sekikawa (JP); Eisuke Maruyama, Tainai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 821 days.

(21) Appl. No.: 13/186,797

(22) Filed: Jul. 20, 2011

(65) Prior Publication Data

US 2012/0047718 A1 Mar. 1, 2012

(30) Foreign Application Priority Data

Aug. 31, 2010 (JP) ..... 2010-193923

(51) Int. Cl.
*H01F 7/06* (2006.01)
*H01F 41/02* (2006.01)

(52) U.S. Cl.
CPC ..... *H01F 41/0226* (2013.01)
USPC ..... 29/606; 29/602.1; 29/604; 29/605; 336/200; 336/234

(58) Field of Classification Search
USPC ..... 29/417, 592.1, 602.1, 604–606; 336/200, 234
See application file for complete search history.

(56) References Cited

U.S. PATENT DOCUMENTS 4,570,141 A * 2/1986 Klappert ..... 336/213
8,375,569 B2 * 2/2013 Fukui et al. ..... 29/738

FOREIGN PATENT DOCUMENTS

JP 62-252118 A 11/1987
JP 4-368109 A 12/1992
JP 05-109562 4/1993
JP 07-066065 3/1995
JP 09-171936 6/1997
JP 2001-160521 A 6/2001
JP 2003-104592 4/2003
JP 2010-021536 1/2010

OTHER PUBLICATIONS

Japanese Office Action issued in Japanese Application No. 2010-193923 issued Oct. 1, 2013.

* cited by examiner

*Primary Examiner* — Paul D Kim
(74) *Attorney, Agent, or Firm* — McDermott Will & Emery LLP

(57) ABSTRACT

A transformer core manufacturing apparatus for manufacturing an annular transformer core having thin plates formed of magnetic materials laminated includes an uncoiler unit which allows a plurality of uncoilers each having a thin plate magnetic material coiled hoop-like to uncoil the magnetic material, a carrier unit for guiding a plurality of the magnetic materials uncoiled from the plurality of the uncoilers as a single group of magnetic body, a first alignment unit for aligning the carried group of the single magnetic body in a width direction, a cut-off unit for cutting the magnetic body aligned by the first alignment unit in a predetermined dimension, a laminating unit for laminating a plurality of the groups of the magnetic body cut by the cut-off unit, a second alignment unit for aligning the magnetic body laminated on the laminating unit, and a control unit for controlling operations of the above cited units.

14 Claims, 14 Drawing Sheets

TRANSFORMER CORE MANUFACTURING APPARATUS AND METHOD

CLAIM OF PRIORITY

The present application claims priority from Japanese Patent Application No. 2010-193923 filed on Aug. 31, 2010, the content of which is hereby incorporated by reference into this application.

BACKGROUND OF THE INVENTION

The present invention relates to transformer core manufacturing apparatus and method, and more particularly, to transformer core manufacturing apparatus and method using a thin plate formed of amorphous magnetic material.

The amorphous magnetic thin plate used for forming the transformer core has a considerably small thickness ranging from 0.022 to 0.025 mm. The core is manufactured by sequentially uncoiling a plurality of magnetic materials from a plurality of uncoilers each having the amorphous magnetic thin plate coiled like hoop, and cutting the uncoiled plurality of magnetic materials in a predetermined dimension while being laminated. They are wound around the coil core to form the core. The amorphous magnetic material is very thin and lightweight, which is easily displaced in the width direction during carriage. So they have to be aligned in the course of the carriage process.

Especially, a plurality of magnetic thin plates are wound in tight state to form the single hoop material, and in most of the cases, the thin plates are wound while being displaced with one another. It is therefore difficult to efficiently align the plurality of the magnetic thin plates which have been separated from the tightly-attached plates one by one. If displaced one of the plurality of thin plates which have been tightly attached is forcedly aligned to the other plates under pressure, in the width direction, crack is likely to occur because of small thickness of the plate. In the state where a plurality of groups each formed of a certain number of the magnetic thin plates are coiled to form the core, it is difficult to correct the displacement of the group with respect to the other one owing to the tightening force resulting from coiling.

In Japanese Unexamined Patent Publication No. 5-109562, predetermined number of a plurality of the hoop-like amorphous magnetic thin plates is cut in the same size. Those cut in the same size a plurality of times are sequentially transferred from the base to the alignment stand so that a plurality of base core plates are laminated while being aligned using the square ruler for alignment at the same position to form the unit laminated body. Subsequently, the next unit laminated body is formed in the same way while having the slightly different size. The respective unit laminated bodies are sequentially wound around the winding up frame by the winding belt to form the iron core.

In Japanese Unexamined Patent Publication No. 9-171936, the predetermined number of the amorphous magnetic thin bands are laminated and cut to have a predetermined length. They are laminated in the predetermined number of stages to be circularly wound sequentially to form the annular iron core. If protruding portion extending from the laminated end surface exists, a backing plate is put on the protruding portion so as to be pressed under the predetermined pressing force. The misaligned protruding portion, thus, may be inserted between the coiled layers for alignment.

In Japanese Unexamined Patent Publication No. 7-66065, a plurality of hoop-like materials uncoiled from the uncoiler are separated by the inlet roller to pass through a deflection adding portion. The material is regulated in the width direction by the width guide roller in the rear stage of the outlet roller. Thereafter, the hoop-like material is pulled by a predetermined dimension by the grip portion (gripper), and cut while having the end surfaces aligned.

SUMMARY OF THE INVENTION

In Japanese Unexamined Patent Publication No. 5-109562, the plurality of core base plates of the unit laminated body are aligned and laminated on the alignment stand using the ruler for alignment so that the iron core is formed by sequentially winding the respective unit laminated bodies by the winding belt. If the contact pressures between the winding belt and the winding frame upon coiling become uneven in the width direction upon winding, the unit laminated boy as the upper layer may be wound while displacing with respect to the unit laminated body as the lower layer. In such a case, correction has to be conducted by uncoiling, requiring complicated operation.

In Japanese Unexamined Patent Publication No. 9-171936, the annular iron core is formed, and the backing plate is put on the misaligned portion protruding from the laminated end surface so as to be pressed. The misaligned portion may be inserted between the coiled layers of the iron core for alignment. As the annular coiled core has the tightening force applied to the portion between the coiled layers, crack may occur in the amorphous magnetic thin plate, or dent may be generated on the magnetic thin plate of the adjacent layer, resulting in deterioration in magnetic properties.

In Japanese Unexamined Patent Publication No. 7-66065, the hoop-like material is regulated in the width direction by the width guide roller at the rear stage portion of the outlet roller of the deflection adding portion. The material is then pulled by the predetermined dimension by the grip portion (gripper) while having the end surface aligned, and cut by the cutter. The end surface in the width direction is aligned so as to be gripped by the gripper in the state where the hoop-like materials are aligned upon cutting. Alignment of the end surface upon formation of the iron core after cutting is not considered.

The present invention provides transformer core manufacturing apparatus and method having the magnetic thin plates accurately aligned upon manufacturing of the transformer core using thin and lightweight magnetic thin plates.

The present invention provides a transformer core manufacturing apparatus for manufacturing an annular transformer core having thin plates formed of magnetic materials laminated which includes uncoiler unit which allows a plurality of uncoilers each having a thin plate magnetic material coiled hoop-like to uncoil the magnetic material, a carrier unit for guiding a plurality of the magnetic materials uncoiled from the plurality of the uncoilers as a single group of magnetic body, a first alignment unit for aligning the carried group of the single magnetic body in a width direction, a cut-off unit for cutting the magnetic body aligned by the first alignment unit in a predetermined dimension, a laminating unit for laminating a plurality of the groups of the magnetic body cut by the cut-off unit, a second alignment unit for aligning the magnetic body laminated on the laminating unit, and a control unit for controlling operations of the respective units.

In the transformer core manufacturing apparatus, the first alignment unit is provided with a lateral vibration unit for vibrating the magnetic body in the width direction.

In the transformer core manufacturing apparatus, the first alignment unit is provided with a vertical vibration unit for vibrating the magnetic body in a laminating direction.

The transformer core manufacturing apparatus is further provided with a roller guide for separating magnetic materials uncoiled from the uncoiler into a single sheet of the magnetic material.

In the transfer core manufacturing apparatus, the laminating unit is provided with a laminating stand on which the magnetic body is laminated. The second alignment unit is provided with an alignment mechanism for aligning the magnetic body as an upper layer laminated on the laminating stand with the magnetic body as the lower layer with respect to the width direction.

In the transfer core manufacturing apparatus, the laminating unit allows the laminating stand to support an intermediate portion of the magnetic body so that both sides are hung down. The alignment mechanism is provided with an alignment member which aligns the intermediate portion and both sides of the laminated magnetic body with those of the magnetic body as the lower layer.

In the transfer core manufacturing apparatus, the alignment mechanism aligns the intermediate portion of the laminated magnetic body with the magnetic body as the lower layer, and then the both sides of the magnetic body with the magnetic body as the lower layer.

In the transformer core manufacturing apparatus, the laminating unit includes a moving mechanism for reciprocating the laminating stand toward the cut-off unit, and a clamp mechanism for pressing the magnetic body against the laminating stand. The magnetic body is pressed against the laminating stand by the moving mechanism and the clamp mechanism at a position close to the cut-off unit. The magnetic body is moved by a predetermined length in a returning step together with the laminating stand.

In transformer core manufacturing apparatus, the uncoiler unit includes a slackness sensor for detecting a predetermined slackness of the magnetic body uncoiled from the uncoiler, and an urging unit for adding the predetermined slackness to the magnetic body uncoiled from the uncoiler.

In the transformer core manufacturing apparatus, the uncoiler unit is provided with supply guides which guide the magnetic bodies uncoiled from the respective uncoilers independently so as not to be in contact with each other.

The present invention provides a transformer core manufacturing method for manufacturing an annular transformer core having thin plates formed of magnetic materials laminated, which includes uncoiling a plurality of magnetic materials as a single group of magnetic body from a plurality of uncoilers each having a thin plate magnetic material hoop-like coiled, aligning the single group of magnetic body uncoiled from the uncoiler using a first alignment unit, cutting the aligned magnetic body in a predetermined dimension, laminating a plurality of groups of the magnetic body which have been cut on a laminating stand, and aligning the laminated magnetic body in a width direction using a second alignment unit.

In the transformer core manufacturing method, the magnetic body is vibrated in the width direction so as to be aligned in the width direction.

In the transformer core manufacturing method, the magnetic body is vibrated in a laminating direction so as to be aligned in the width direction.

In the transformer core manufacturing method, the uncoiled magnetic body is separated into each of sheets one by one, and the magnetic body is aligned in the width direction using the first alignment unit.

In the transformer core manufacturing method, the laminated magnetic body as an upper layer is aligned with the magnetic body as a lower layer in the width direction using a second alignment unit.

In the transformer core manufacturing method, the magnetic body is laminated having its intermediate portion supported by the laminating stand and both sides hung down. The laminated magnetic body is aligned with the magnetic body as the lower layer with respect to the intermediate and both sides.

In the transformer core manufacturing method, the intermediate portion of the magnetic body is aligned with the magnetic body as the lower layer, and then both sides of the magnetic body are aligned with the magnetic body as the lower layer for aligning the group of the laminated magnetic body in the width direction.

In the transformer core manufacturing method, the magnetic body aligned by the first alignment unit is carried by a predetermined distance together with the laminating stand while being pressed against the laminating stand, and then the magnetic body is cut in a predetermined dimension.

In the transformer core manufacturing method, a predetermined slackness is added to each of a plurality of magnetic bodies uncoiled from the plurality of uncoilers through urging.

In the transformer core manufacturing method, the magnetic bodies uncoiled from the respective uncoilers are guided independently so as not to be in contact with each other.

According to the present invention, alignment of a single group of magnetic body formed of a plurality of magnetic materials, and each group of the magnetic body are conducted in the width direction in two stages, respectively to allow efficient alignment of the end surface of the transformer core in the width direction with high accuracy.

DESCRIPTION OF THE PREFERRED EMBODIMENTS

Figure 1A:
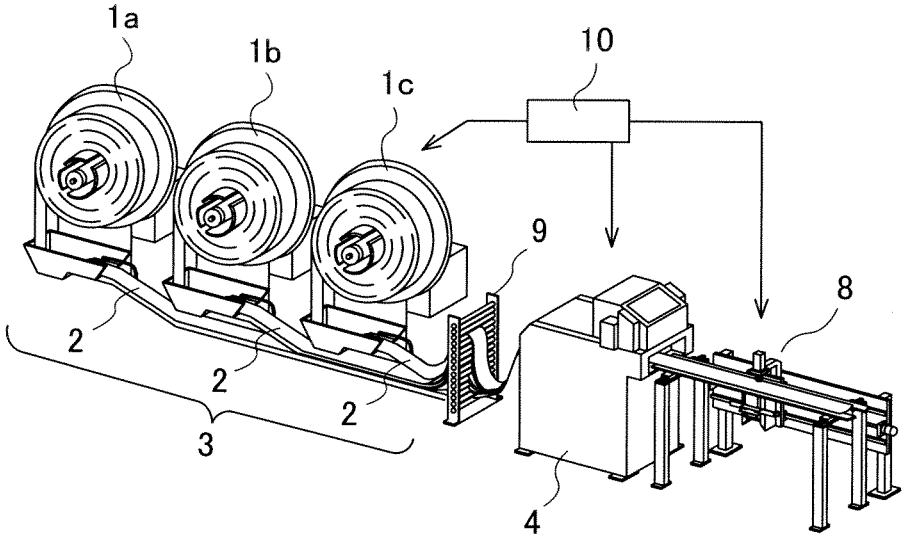
FIG. 1A is a perspective view showing a manufacturing apparatus as a whole according to an embodiment of the present invention.
Figure 1B:
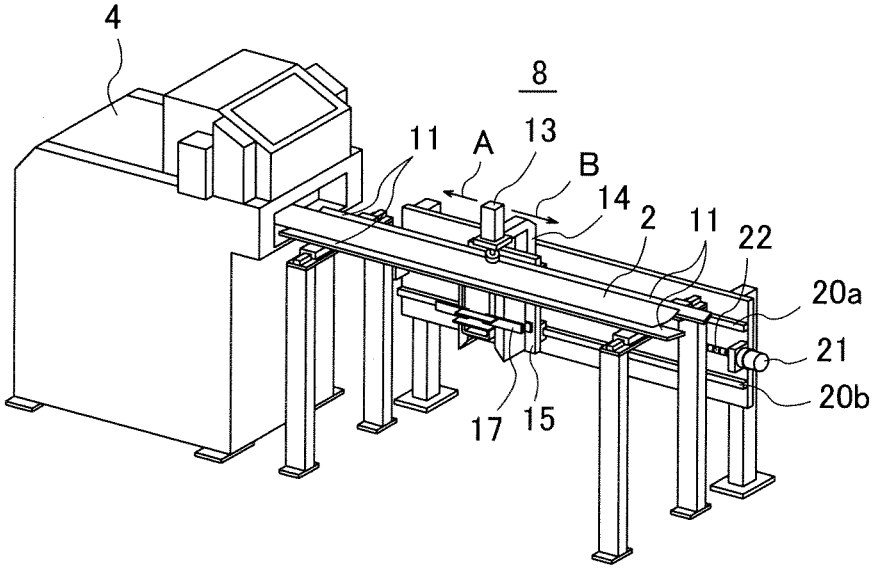
FIG. 1B is an enlarged view of an essential portion of the manufacturing apparatus according to the embodiment of the present invention.

FIGS. 1A and 1B show a manufacturing apparatus according to an embodiment of the present invention. FIG. 1A is a perspective view showing a general structure of the apparatus, and FIG. 1B is an enlarged view of a laminating unit 8. Likewise, FIG. 2 is a side view of the manufacturing apparatus illustrating the operation of the manufacturing apparatus.

Figure 2:
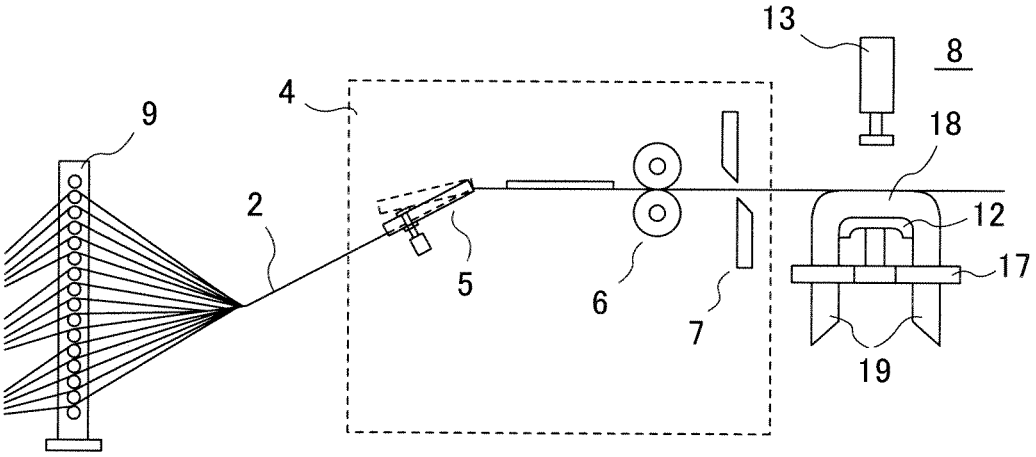
FIG. 2 is a side view explaining the operation of the manufacturing apparatus.

Referring to FIGS. 1A, 1B, and 2, an uncoiler unit 3 serves to uncoil a magnetic body 2 from three uncoilers 1 (uncoilers 1*a* to 1*c*) each coiled with the amorphous thin plate magnetic material like a hoop. Each of the uncoilers is coiled with 5 sheets of amorphous thin plates while being laminated. Fifteen sheets of magnetic materials in total are uncoiled as a group of the magnetic body 2 from the entire uncoilers. A carrier unit 4 serves to carry the uncoiled magnetic body 2, which is provided with a first alignment unit 5 for aligning the magnetic body 2 in the width direction, carrier rollers 6, and a cut-off unit 7 for cutting the magnetic body aligned in the width direction in the predetermined dimension. A laminating unit 8 allows a plurality of groups of the cut magnetic bodies 2 to be laminated. A roller guide unit 9 is provided between the uncoiler unit 3 and the carrier unit 4, and separates the 5 sheets of thin plate magnetic materials coiled around each of the uncoilers 1*a* to 1*c* one by one, respectively. A control unit 10 serves to control operations of the respective units.

Figure 3:
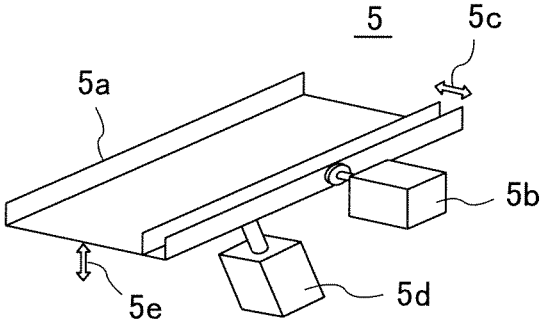
FIG. 3 is a perspective view of an alignment portion.

Referring to FIG. 3, the first alignment unit 5 includes a tray 5*a* on which 15 sheets of the thin plate magnetic materials for forming the magnetic body 2 are placed, a lateral vibration unit 5*b* formed as a cylinder for laterally vibrating the tray 5*a* (in the direction of arrow 5*c* in the width direction of the magnetic material), and a vertical vibration unit 5*d* as the cylinder for vibrating the tray 5*a* in the laminating direction (direction 5*e* of arrow in the magnetic material laminating direction). The lateral vibration unit 5*b* laterally vibrates to align the 15 sheets of magnetic materials in the width directions, and the vertical vibration unit 5*d* vibrates in the vertical direction to align the 15 sheets of magnetic materials in the vertical direction.

Figure 4:
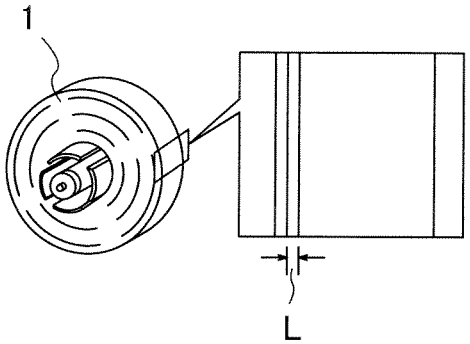
FIG. 4 is an explanatory view showing a coiled state of the magnetic thin plate.

Referring to FIG. 4, each of the uncoilers 1 is wound in tight with 5 sheets of amorphous thin plate magnetic materials while having "displacement L" in the width direction. In the embodiment, the magnetic material is allowed to pass the roller guide 9 to separate the 5 sheets of tightly contact materials one by one, and the vertical vibration of the first alignment unit 5 serves to align magnetic materials in the width direction under the lateral vibration having each sheet of the magnetic materials separated. The single sheet of the amorphous thin plate as the magnetic material is brittle. The vertical vibration serves to align the magnetic materials one by one to prevent application of excessive force to each of the thin plates. Therefore no damage occurs, and accordingly, efficient alignment is established.

The thus aligned single group of the magnetic body 2 passes through the rotating upper and lower carrier rollers 6, and is fed into the laminating unit 8. The magnetic body 2 is carried by a predetermined distance, and stopped while being interposed between the carrier rollers 6. It is cut by the cut-off unit in the predetermined size while being interposed between the carrier rollers 6 so as to provide 15 sheets of the thin plates which are cut with high accuracy.

As FIGS. 1A, 1B and 2 show, the laminating unit 8 is provided to communicate with the outlet of the carrier unit 4, and includes a long guide tray 11 for guiding both sides of the carried magnetic body 2 in the width direction. The guide tray 11 is formed of two side units apart from the center, which slope upward. It is configured to be movable in the width direction together with the alignment mechanism to be described later.

The center of the guide tray 11 (gap) is provided with a saddle-like laminating stand 12 and a clamp mechanism 13 formed of a cylinder at lower and upper portions to interpose the magnetic body. The magnetic body 2 fed from the carrier unit 4 is guided to the position above the laminating stand 12 while being supported at the guide tray 11. The clamp mechanism 13 is moved up and down to lower a material presser 13*a* to press the magnetic body 2. The center portion of the magnetic body 2 in the width direction is then deformed and pressed against the laminating stand 12. The pressed magnetic body 2 is slid down from the tray when the guide tray 11 is opened in the width direction so as to be laminated on the laminating stand 12 as a whole.

A backboard 15 serves to fix the laminating stand 12, and the clamp mechanism 13 via a frame 14.

Referring to FIG. 2, the magnetic body 2 cut in the predetermined size is laminated on the laminating stand 12 having the intermediate portion 18 rested thereon and both sides 19 hung down. A second alignment unit is provided for aligning both end surfaces of the thus laminated magnetic body 2 in the width direction. The second alignment unit is fixed to the backboard 15 using a not shown member.

The second alignment unit includes a mechanism 16 for aligning the intermediate portion 18 of the laminated magnetic body in the width direction, and a mechanism 17 for aligning both sides 19 of the magnetic body in the width direction. As FIG. 5B shows, the alignment mechanism 16 includes a pair of alignment members 16*a* and 16*b* which are provided opposite both side ends of the intermediate portion 18 of the magnetic body 2, and may be opened and closed. The alignment mechanism 17 includes a pair of alignment members 17*a* and 17*b* opposite both sides 19 of the magnetic body 2, and may be opened and closed. The alignment mechanism 17 has a long length across the both sides of the magnetic body 2. Those both sides 19 are gripped to align the magnetic body in the width direction. The alignment member 17*b* of the alignment mechanism 17 is fixed to the backboard 15, and the other alignment member 17*a* is only made movable.

If the magnetic body 2 is relatively short, it is carried only by driving the carrier rollers 6 by a predetermined length, and then cut in the predetermined size. When the magnetic body 2 becomes long, the carriage distance is increased, which may cause contact friction between the magnetic body and the guide tray 11 during the carriage, resulting in jam (clogging) owing to corrugation of the magnetic body 2. The aforementioned phenomenon tends to occur easily in the magnetic body for large-sized transformer. Once such jam occurs, it is no longer possible to accurately feed the magnetic body by the desired distance, thus failing to cut off the magnetic body in the accurate size.

This example is structured to move the magnetic body 2 while being pressed (gripped) against the laminating stand 12 by the clamp mechanism 13 from above so that the long magnetic body 2 is carried. The moving mechanism will be described hereinafter.

Referring to FIG. 1B, the laminating unit 8 is provided with a moving mechanism for reciprocating the backboard 15 with respect to the cut-off unit 7. The moving mechanism is formed of two guide rails 20 (20*a*, 20*b*) for guiding the backboard 15 upon moving, a long screw 22 for driving operation, and a motor 21 for driving and rotating the long screw. The two guide rails 20 and the long screw 22 are provided parallel to the guide tray 11. Guide grooves 15*a* and 15*b* which move while being engaged with the guide rails 20, and a screw hole 15*c* threaded with the long screw 22 are provided on the back surface of the backboard 15 as the moving mechanism.

When the long screw 22 is driven to rotate by the motor 21, the backboard 15 reciprocates in directions of arrows A and B shown in FIG. 1B. Accompanied with the reciprocating operation, the laminating stand 12 and the clamp mechanism 13 reciprocate in the directions of arrows A and B.

Carriage of the magnetic body 2 by the aforementioned structure will be described. Upon instruction of the control unit 10, the magnetic body 2 is moved toward the cut-off unit 7 while having the laminating stand 12 and the clamp mechanism 13 kept opened (upper pressing is released), and stopped at a predetermined position. The clamp mechanism 13 moves down at the stopped position to press the magnetic body 2 against the laminating stand 12. In this state, the laminating stand 12 and the clamp mechanism 13 are moved to the original positions. During the carriage, the upper and the lower carriage rollers 6 are stopped to release the magnetic body 2. The laminating stand 12 and the clamp mechanism 13 are stopped when they reach the position from the cut-off unit 7 together with the magnetic body 2 by a predetermined distance (predetermined cut length of the magnetic body 2) so that the magnetic body 2 is cut by the cut-off unit 7.

In Japanese Unexamined Patent Publication No. 7-66065, the hoop-like material is pulled by the dedicated grip portion (gripper). The structure as described above allows the laminating stand 12 and the clamp mechanism 13 for laminating and aligning the magnetic body 2 so as to be moved, thus eliminating the structure dedicated for gripping, thus simplifying the structure.

Operations of the apparatus will be described referring to the respective drawings. The apparatus is formed as the one having all the operations automatically controlled based on the instruction of the control unit 10.

Figure 5A:
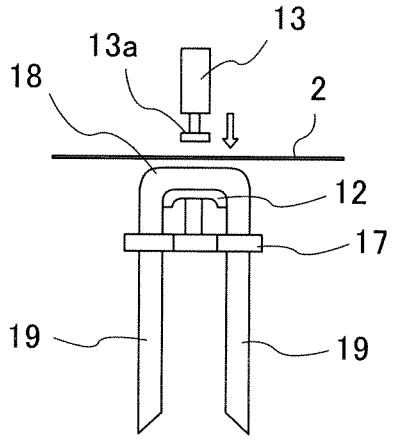
FIGS. 5A and 5B are explanatory views of a state before clamping of the magnetic material of a laminated portion.
Figure 5B:
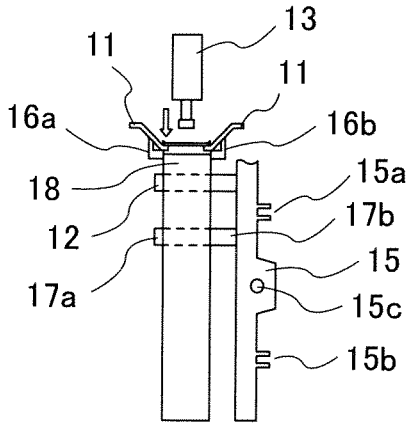

Referring to FIGS. 1A and 1B, 5 sheets of magnetic materials uncoiled from each of three uncoilers 1*a* to 1*c* of the uncoiler unit 3, that is, 15 sheets of magnetic materials in total are uncoiled as the single group of magnetic body 2. The uncoiled magnetic body 2 is separated by the roller guide 9 one by one so as to be fed to the carrier unit 4. In the carrier unit 4, 15 sheets of the magnetic materials are aligned in the width direction under vertical and lateral vibrations of the first alignment unit 5, and then fed by the carriage rollers 6 toward the cut-off unit 7. The magnetic body 2 is further carried to the laminating unit 8 while being guided by the guide tray 11 to stop at the position from the cut-off unit 7 by a predetermined distance. It is then cut by the cut-off unit 7. As the magnetic body 2 aligned in the width direction is interposed between the carriage rollers 6 and cut, the magnetic materials may be cut in the predetermined length while being aligned.

Figure 6A:
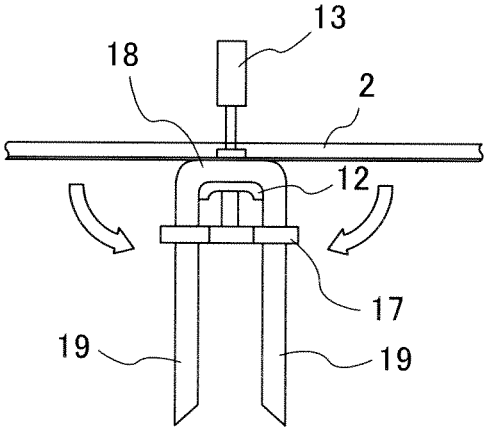
FIGS. 6A and 6B are explanatory views of a state after clamping of the magnetic material of the laminated portion.
Figure 6B:
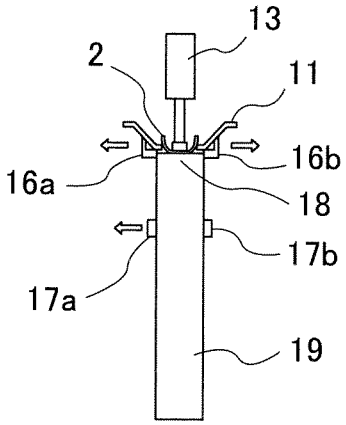

The magnetic body 2 cut in the predetermined size by the cut-off unit 7 are put on the guide tray 11 so that the intermediate portion is positioned above the laminating stand 12. Then the material presser 13*a* of the clamp mechanism 13 moves down to press the magnetic body 2 against the laminating stand 12 from above. At this time, the alignment mechanisms 16 (16*a*, 16*b*) are closed together with the guide tray 11, and both sides of the magnetic body 2 are received by the tray 11. Referring to FIGS. 6A and 6B, the magnetic body 2 is deformed from the separate portion of the guide tray 11 to have U-like cross-section in the width direction, and pressed against the laminating stand 12. The deformation into the U-like cross-section extends along the longitudinal direction of the magnetic body 2 as shown in FIG. 6A.

The magnetic body as the lower layer has been already laminated on the laminating stand 12, and then the intermediate portion of the magnetic body 2 is pressed against the intermediate portion 18 of the magnetic body as the lower layer. The intermediate portion 18 denotes the one of the magnetic body as the lower layer which has been already laminated, and both sides 19 denote those of the magnetic body as the lower layer which has been already laminated as well.

Figure 7A:
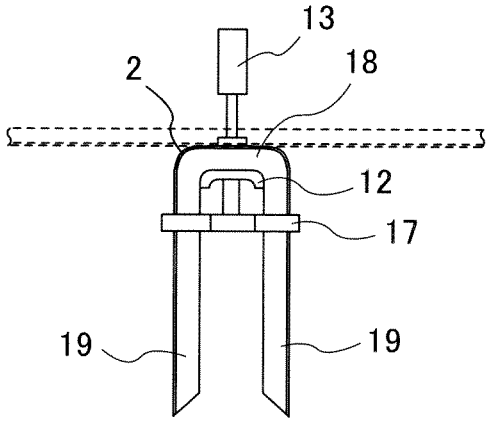
FIGS. 7A and 7B are explanatory views of a state where both sides are hung down.
Figure 7B:
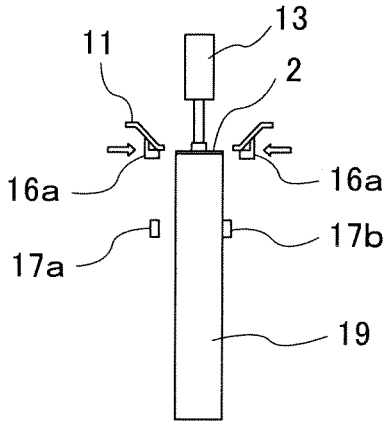

As FIG. 6B shows, the alignment members 16*a* and 16*b* of the alignment mechanism 16 are released and moved in the arrow direction together with the guide tray 11. The alignment member 17*a* of the alignment mechanism 17 is moved in the arrow direction. As both the alignment mechanisms 16, 17 and the guide tray 11 are released, the magnetic body 2 has its both ends dropped from the tray 11 and hung down in the arrow direction of FIG. 6A so as to be laminated on the magnetic body as the lower layer. FIGS. 7A and 7B show the laminated state.

Figure 8A:
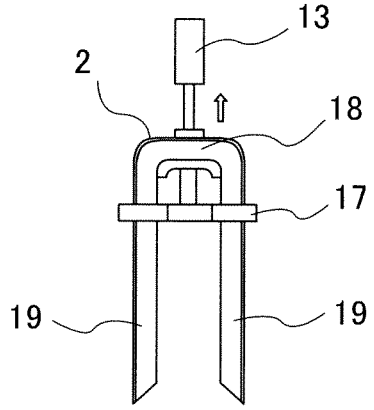
FIGS. 8A and 8B are explanatory views of a state where the intermediate portions are aligned.
Figure 8B:
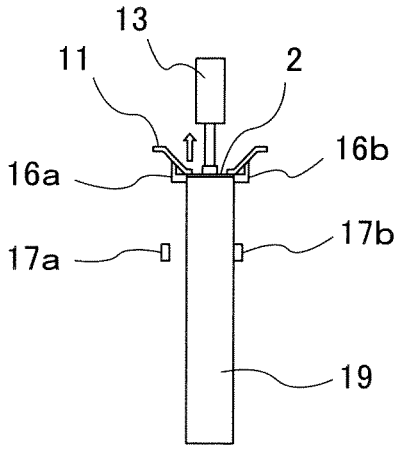
Figure 9A:
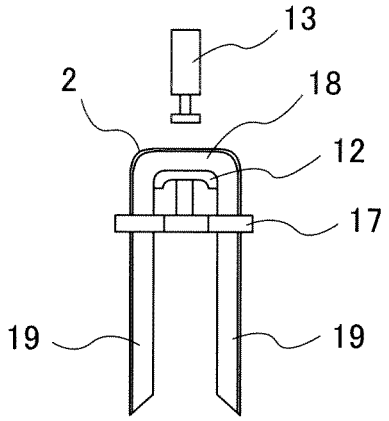
FIGS. 9A and 9B are explanatory views of a state where both sides are aligned.
Figure 9B:
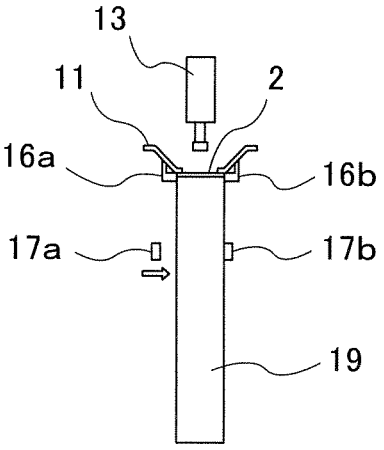

As FIG. 7B shows, the alignment members 16*a* and 16*b* of the alignment mechanism 16 start moving to the closing direction indicated by arrow, and are closed as shown in FIGS. 8A and 8B. Simultaneously, the clamp mechanism 13 is lifted up in the arrow direction. As FIGS. 9A and 9B show, in the state where the clamp mechanism 13 is released, the intermediate portion of the magnetic body 2 has both ends gripped by the alignment members 16*a* and 16*b* in the width direction so that it is aligned with the intermediate portion 18 of the magnetic body as the lower layer. Upper half portions of the alignment members 16*a* and 16*b* abut on the intermediate portion of the magnetic body 2, and the lower half portions abut on the intermediate portion 18 of the magnetic body as the lower layer. The intermediate portions of the single group of the magnetic body 2 to be laminated on the intermediate portion 18 of the magnetic body as the lower layer may be accurately aligned.

Figure 10A:
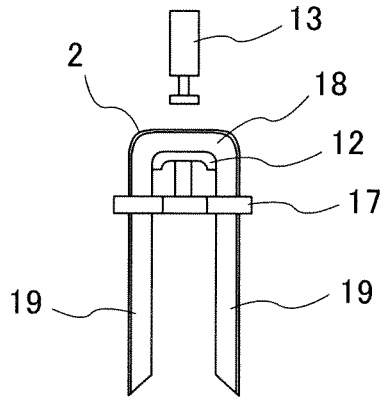
FIGS. 10A and 10B are explanatory views of a state where the intermediate and both sides are aligned.
Figure 10B:
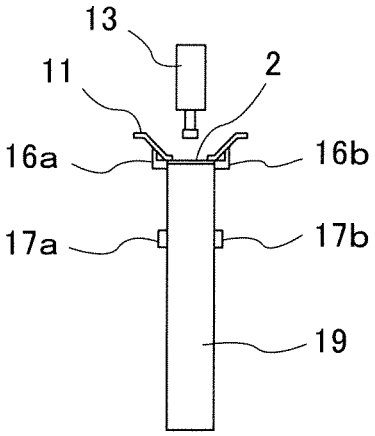

As shown in FIG. 9B, the alignment member 17*a* moves in the arrow direction and is closed, and both sides of the magnetic body 2 are gripped by the alignment members 17*a* and 17*b* in the width direction so as to be aligned with the both sides 19 of the magnetic body as the lower layer (see FIGS. 10A and 10B). As the alignment member 17*a* has a long length, and presses both sides 19 of the magnetic body as the lower layer and those of the magnetic body 2 simultaneously, the both sides of the magnetic body 2 are laminated on those sides 19 of the magnetic body as the lower layer in the well aligned state.

The intermediate portion of the magnetic body 2 is aligned first with the alignment members 16*a* and 16*b*, and then both sides of the magnetic body 2 are aligned with the alignment members 17*a* and 17*b*. Upon alignment of the intermediate portion of the magnetic body 2 first, both sides are in the free state. This makes it possible to easily align the intermediate portion with accuracy without forcible resistance. Upon alignment of both sides of the magnetic body 2, the aligned intermediate portion is gripped by the alignment members 16*a* and 16*b* in the width direction and fixed. This makes it possible to align the sides with those of the magnetic body as the lower layer.

Upon alignment of the magnetic body 2 using the alignment mechanisms 16 and 17, the mass of the magnetic bodies 2 to be aligned is relatively small because the magnetic body 2 is aligned with the one as the lower layer for each group. This makes it possible to easily perform the alignment while preventing crack in the magnetic material. The single group of the magnetic body 2 includes 15 sheets of the magnetic materials in a bundle. The resultant rigidity is high, and crack hardly occurs even if it is forcibly pressed by the alignment members 16*a*, 16*b*, 17*a* and 17*b*.

When the number of the sheets laminated on the laminating stand 12 reaches the predetermined value after repetition of laminating operations, the lamination of the magnetic body 2 is terminated. The finished laminated magnetic body is transferred to the core (not shown), and the lower ends are formed into the U-like shape to form the coil core. As the drawing shows, the magnetic body aligned on the laminating stand 12 has a long length at the outer circumferential side, and short length at the inner circumferential side. Each lower end of both sides 19 is inclined for laminating operation. The inclined lower ends abut with each other or are laminated together to form the U-like shape to configure the coil core.

According to the example, alignments are conducted in two stages, that is, alignment of the single group of magnetic body formed of a plurality of magnetic material sheets in the width direction, and alignment among those groups. This makes it possible to efficiently align the end surface of the transformer core in the width direction with high accuracy.

If the end surfaces of the core are not aligned, coiling is conducted so as not to be in contact with the most protruding magnetic material, which may enlarge the coil diameter, resulting in enlarged core as a whole. In this example, the end surface of the core in the width direction may be aligned with high accuracy, which makes it possible to reduce the diameter of the coil wound around the core, resulting in reduced size of the core as a whole.

When applying the resin coating to the surface of the transformer core, it is applied to the end surface of the core. The resin may be efficiently applied to the aligned end surface with high accuracy. In case of misaligned end surface, the material needs to be hit for alignment, which may increase the number of steps and causes the risk of damaging the magnetic material.

As described above, the apparatus is structured to have all the operations automatically controlled based on the instruction of the control unit 10, resulting in unmanned system for reducing manpower cost and man-hours.

The operation for carrying the magnetic body 2 using the laminating stand 12 and the clamp mechanism 13 will be described.

Figure 11:
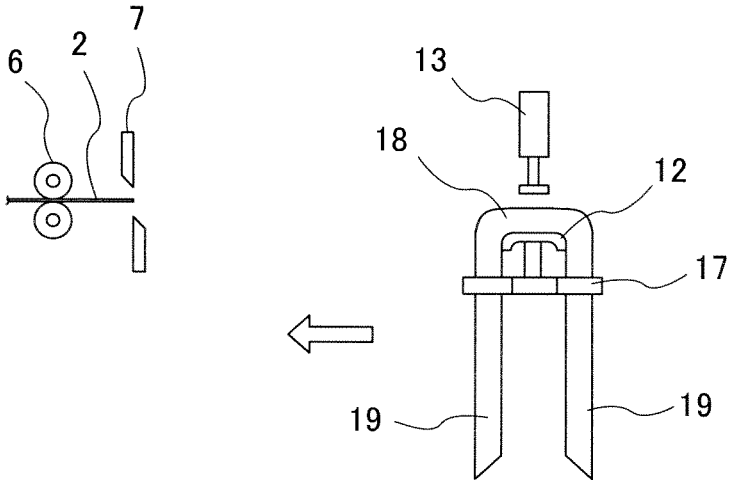
FIG. 11 is an explanatory view of a state where a laminating stand is moved to the cut-off unit.
Figure 12:
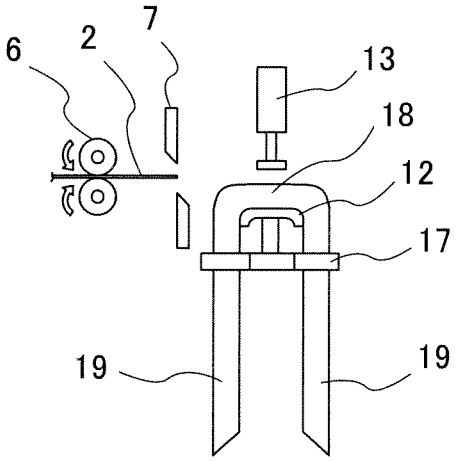
FIG. 12 is an explanatory view of a state after movement of the laminating stand to the cut-off unit.
Figure 13:
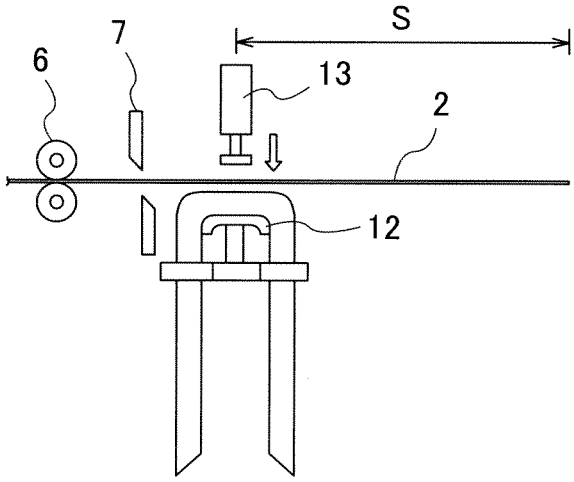
FIG. 13 is an explanatory view of the operation for pressing the magnetic material.
Figure 14:
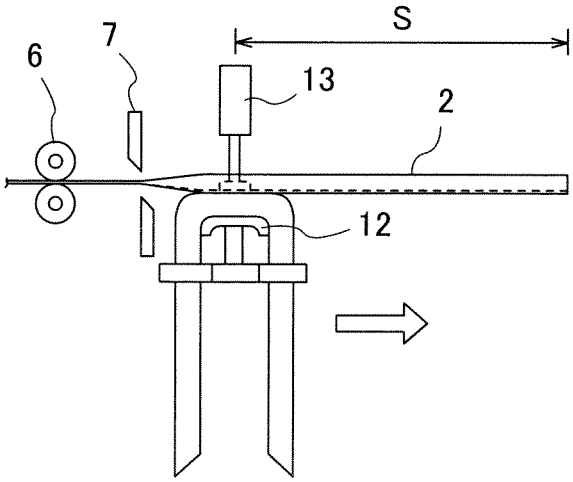
FIG. 14 is an explanatory view of a state where the magnetic material has been pressed.

Referring to FIG. 11, rotation of the long screw 22 moves the laminating stand 12 (magnetic body has been already laminated as the lower layer) and the clamp mechanism 13 move together with the backboard 15 in the arrow direction. The laminating stand 12 and the clamp mechanism 13 stop at the predetermined position adjacent to the cut-off unit 7. At this moment, the laminating stand 12 and the clamp mechanism 13 are opened (see FIG. 12). Then the carrier rollers 6 start rotating in the arrow direction to carry the magnetic body 2 toward the laminating stand 12, and stops carrying when the magnetic body is moved by a predetermined distance (see FIG. 13). Assuming that the desired length of the magnetic body 2 is set to 2S, the predetermined distance is defined as the length S from the leading end of the magnetic body 2 to reach the center of the laminating stand 12 and the clamp mechanism 13. At the stopped position, the clamp mechanism 13 is moved down to press the magnetic body 2 against the laminating stand 12 (see FIG. 14).

Figure 15:
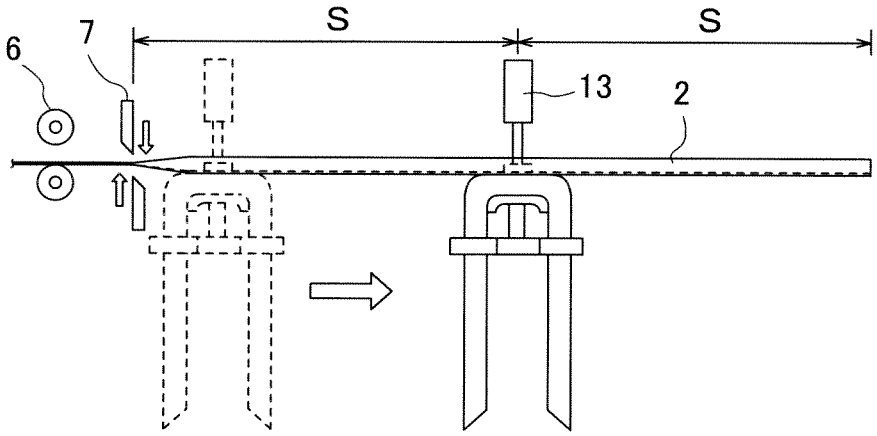
FIG. 15 is an explanatory view of the resuming operation while keeping the magnetic material pressed.
Figure 16:
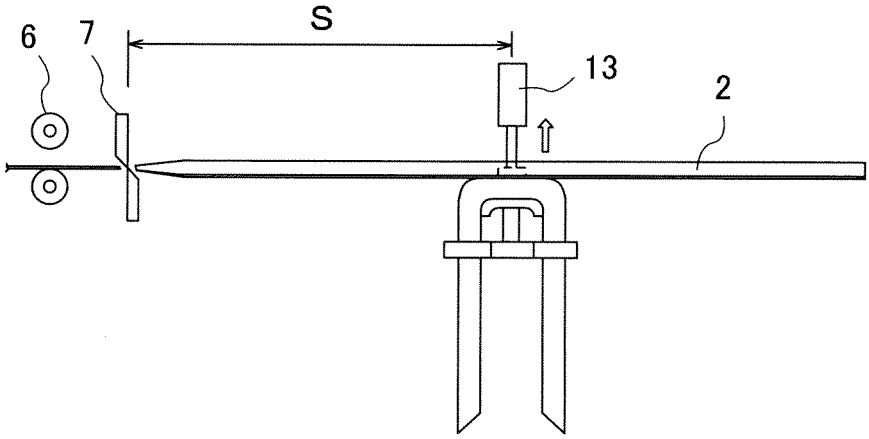
FIG. 16 is an explanatory view of the operation for releasing the magnetic material.
Figure 17:
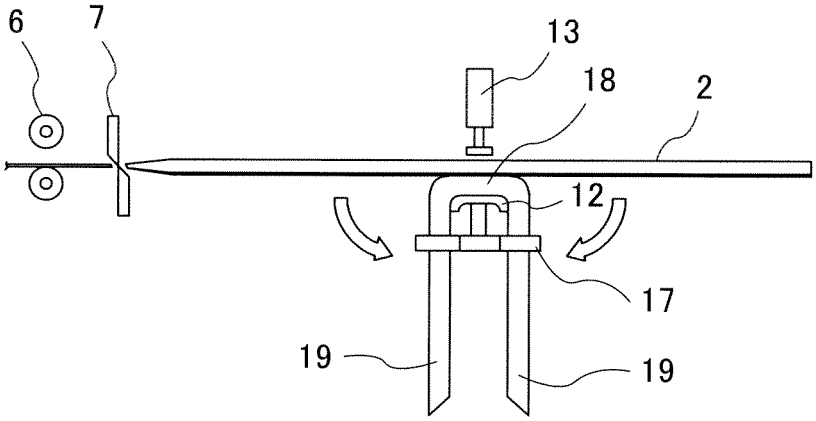
FIG. 17 is an explanatory view showing how the magnetic material is hung down.
Figure 18:
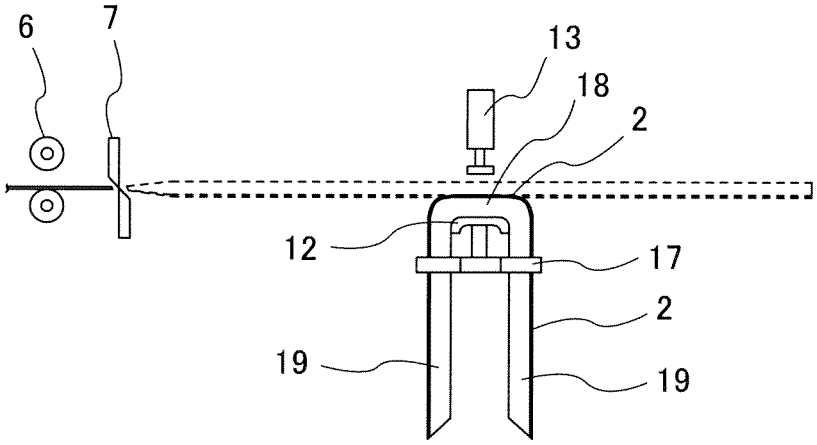
FIG. 18 is an explanatory view of a state where the magnetic material is hung down.

Referring to FIG. 15, the carrier rollers 6 are opened to release the magnetic body 2 and it is transferred in the arrow direction while being gripped by the clamp mechanism 13 and the laminating stand 12. Then they are stopped at the predetermined position. The predetermined position denotes the one at which the leading end of the magnetic body 2 reaches the position the distance corresponding to the length 2S from the cut-off unit 7. The magnetic body 2 is cut at this stopped position. After cutting the magnetic body 2, the clamp mechanism 13 is lifted up to release the magnetic body 2 (see FIGS. 16 and 17). When the magnetic body 2 is released from the clamp mechanism 13, and the alignment mechanisms 16 and 17 are released likewise the operation as described above shown in FIGS. 6A, 6B, 7A and 7B, both sides of the magnetic body 2 are hung down in the arrow direction as shown in FIG. 17, and laminated on the magnetic body as the lower layer as shown in FIG. 18.

Alignment of the magnetic body 2 in the width direction laminated on the one as the lower layer is performed with respect to the intermediate portion 18 and both sides 19 of the magnetic body as the lower layer by opening and closing the alignment mechanisms 16 and 17 likewise the operation as shown in FIGS. 7A to 10B.

Figure 19:
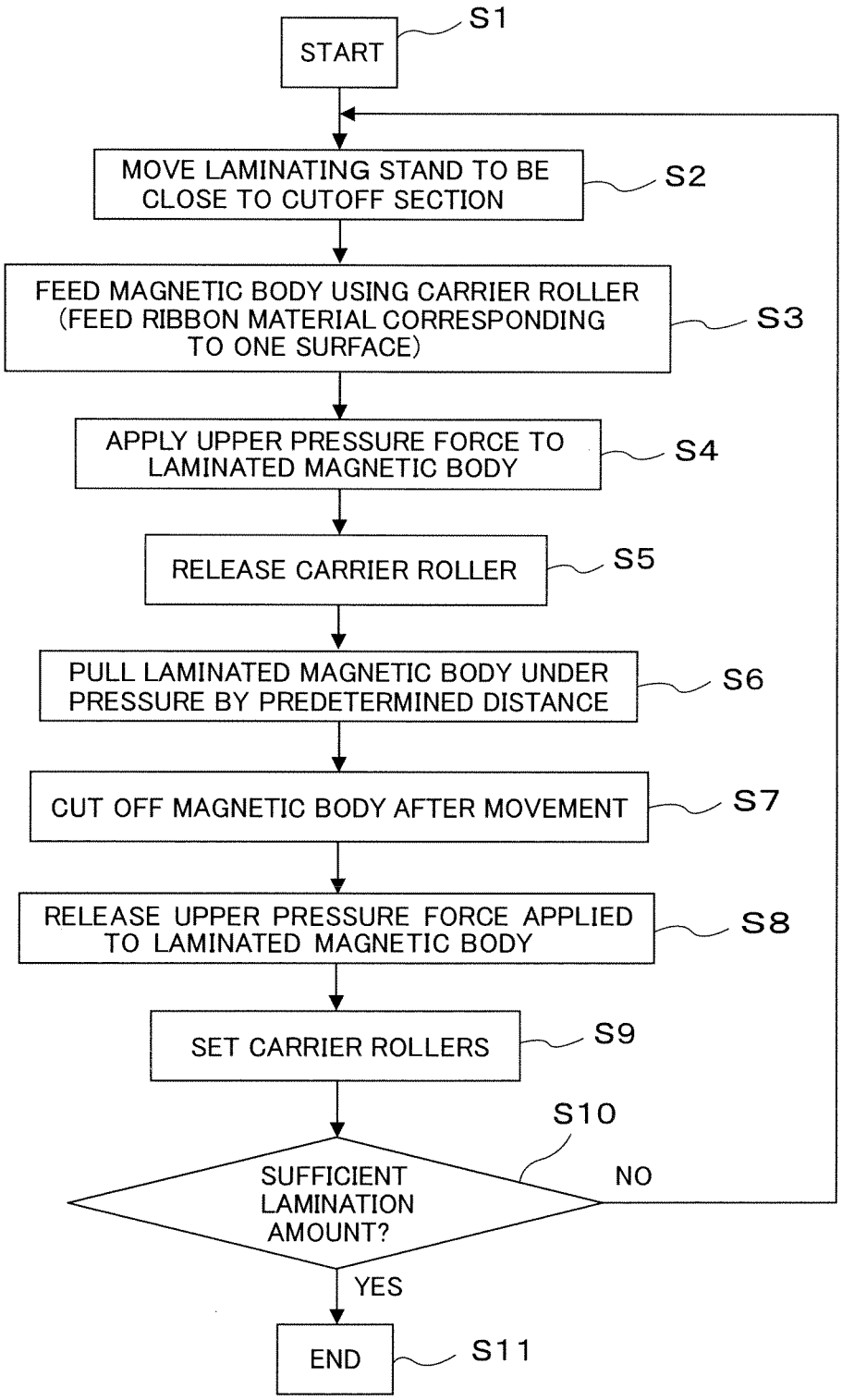
FIG. 19 is a flowchart of the operation.

The aforementioned operation will be described referring to the flowchart. When starting the operation in step 1 (S1) shown in the flowchart of FIG. 19, the laminating stand 12 and the clamp mechanism 13 are moved to be close to the cut-off unit 7 in S2. In S3, the magnetic body 2 is pulled by the carrier rollers 6 by an amount corresponding to the predetermined dimension. In S4, the fed magnetic body 2 is pressed from above by the clamp mechanism 13 against the laminating stand 12, and the carrier rollers 6 are released in S5. In S6, the magnetic body 2 is moved (pulled) by a predetermined distance while being gripped between the clamp mechanism 13 and the laminating stand 12, and it is stopped at a predetermined position and then cut off in S7. The pressing of the magnetic body 2 from above by the clamp mechanism 13 is released in S8, and the carrier rollers 6 are set (closed) to wait until the subsequent carriage of the magnetic body in S9. It is checked whether the predetermined number of the magnetic bodies 2 are laminated on the laminating stand 12 in S10. If the number of the magnetic bodies has not reached the predetermined value yet, the process returns to S2 where the same operations are repeatedly performed. If it has reached the predetermined value, the process proceeds to S11 where the laminating operation is terminated.

Uncoiling of the magnetic body from the uncoiler will be described. The magnetic body 2 formed of 5 magnetic materials fed from the respective uncoilers 1*a* to 1*c* is laminated to include many sheets (15 sheets). Because of the weight of the laminated structure, the magnetic material as the lower layer is unlikely to move, which may cause the risk of displacement and jamming. In Japanese Unexamined Patent Publication No. 7-66065, the magnetic materials uncoiled from the plurality of the uncoilers are fed while being laminated, which may cause the aforementioned problem.

Figure 20:
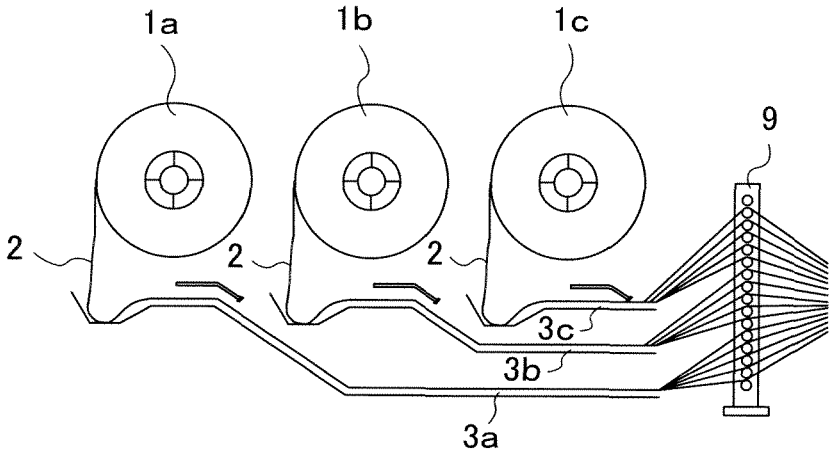
FIG. 20 shows a structure of an uncoiler unit according to the embodiment of the present invention.

In this example, the magnetic bodies 2 uncoiled from the respective uncoilers are guided by the corresponding dedicated supply guides 3*a*, 3*b* and 3*c* as shown in FIG. 20. In the case where the magnetic body 2 fed from the other uncoiler is laminated, its weight is not added. They are guided by the respective supply guides 3*a*, 3*b* and 3*c* to the position of the roller guide 9, thus preventing displacement and jamming in the magnetic body 2.

As described above, the operation for laminating the magnetic body 2 is intermittent because the operation has to be stopped for cutting the magnetic body during the carriage. Meanwhile, the uncoiling from the uncoiler is continuously operated from the aspect of operation efficiency. The uncoiled magnetic body 2 has to have slackness to a certain degree so that both the intermittent operation and the continuous operation are smoothly performed. A sensor 3*d* for monitoring the slackness (detecting existence of the magnetic body) is provided at a predetermined position of the supply guide 3 for ensuring the predetermined slackness.

Figure 21A:
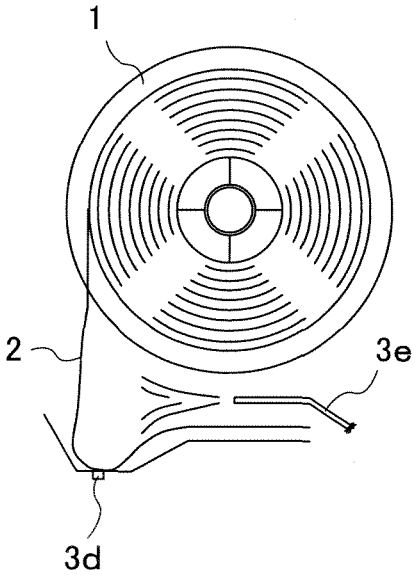
FIGS. 21A and 21B show enlarged structures of the uncoiler unit.

In case of the uncoiler with the large coil diameter for the magnetic material referring to FIG. 21A, the magnetic body 2 largely uncoiled from the outer circumference of the uncoiler passes the sensor 3*d*, and accordingly, detection of the magnetic material is ensured. However, in case of the uncoiler having the coil diameter reduced accompanied with progress of uncoiling, the magnetic body 2 uncoiled downward from the outer circumference of the uncoiler takes the short-cut path as indicated by the dashed line 2*a* in FIG. 21B rather than passing the sensor 3*d*. The measure taken for the aforementioned problem may deteriorate the operation rate of the apparatus.

Figure 21B:
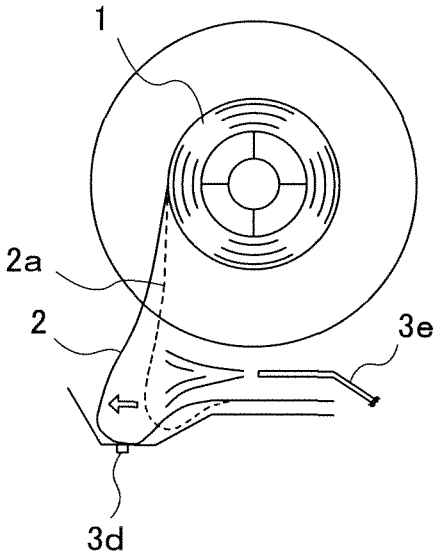

In this example, an air nozzle 3*e* is provided as an urging member for adding the slackness to the uncoiled magnetic body 2 as shown in FIGS. 21A and 21B. Air supplied from the nozzle 3*e* constantly adds the slackness (urging) to the uncoiled magnetic body 2 at the side of the slackness sensor 3*d*. This ensures detection of the magnetic body uncoiled from the uncoiler with small core diameter.

What is claimed is:

1. A transformer core manufacturing apparatus for manufacturing an annular transformer core having thin plates formed of magnetic materials laminated, comprising:

an uncoiler unit which allows a plurality of uncoilers each having a thin plate magnetic material coiled hoop-like to uncoil the magnetic material;

a carrier unit for guiding a plurality of the magnetic materials uncoiled from the plurality of the uncoilers as a single group of magnetic body;

a first alignment unit for aligning the carried group of the single magnetic body in a width direction;

a cut-off unit for cutting the magnetic body aligned by the first alignment unit in a predetermined dimension;

a laminating unit for laminating a plurality of the groups of the magnetic body cut by the cut-off unit;

a second alignment unit for aligning the magnetic body laminated on the laminating unit in the width direction; and a control unit for controlling operations of the uncoiler unit, the carrier unit, the first alignment unit, the cut-off unit, the laminating unit, and the second alignment unit, wherein the first alignment unit is provided with at least one of a lateral vibration unit for vibrating the magnetic body in the width direction and a vertical vibration unit for vibrating the magnetic body in a laminating direction.

2. The transformer core manufacturing apparatus according to claim 1, further comprising a roller guide for separating magnetic materials uncoiled from the uncoiler into a single sheet of the magnetic material.

3. The transformer core manufacturing apparatus according to claim 1, wherein the uncoiler unit includes a slackness sensor for detecting a predetermined slackness of the magnetic body uncoiled from the uncoiler, and an urging unit for adding the predetermined slackness to the magnetic body uncoiled from the uncoiler.

4. The transformer core manufacturing apparatus according to claim 1, wherein the uncoiler unit is provided with supply guides which guide the magnetic bodies uncoiled from the respective uncoilers independently so as not to be in contact with each other.

5. A transformer core manufacturing method for manufacturing an annular transformer core having thin plates formed of magnetic materials laminated, comprising the steps of:

uncoiling a plurality of magnetic materials as a single group of magnetic body from a plurality of uncoilers each having a thin plate magnetic material hoop-like coiled;

aligning the single group of magnetic body uncoiled from the uncoiler using a first alignment unit;

cutting the aligned magnetic body in a predetermined dimension;

laminating a plurality of groups of the magnetic body which have been cut on a laminating stand; and aligning the laminated magnetic body in a width direction using a second alignment unit, wherein the magnetic body is vibrated at least in one direction of the width direction so as to be aligned in the width direction and a laminating direction so as to be aligned in the width direction.

6. The transformer core manufacturing method according to claim 5, wherein the uncoiled magnetic body is separated into each of sheets one by one, and the magnetic body is aligned in the width direction using the first alignment unit.

7. The transformer core manufacturing method according to claim 5, wherein the laminated magnetic body as an upper layer is aligned with the magnetic body as a lower layer in the width direction using the second alignment unit.

8. The transformer core manufacturing method according to claim 7, wherein: the magnetic body is laminated having an intermediate portion supported by the laminating stand and both sides hung down; and the laminated magnetic body is aligned with the magnetic body as the lower layer with respect to the intermediate and both sides.

9. The transformer core manufacturing method according to claim 8, wherein the intermediate portion of the magnetic body is aligned with the magnetic body as the lower layer, and then both sides of the magnetic body are aligned with the magnetic body as the lower layer for aligning the group of the laminated magnetic body in the width direction.

10. The transformer core manufacturing method according to claim 5, wherein the magnetic body aligned by the first alignment unit is carried by a predetermined distance together with the laminating stand while being pressed against the laminating stand, and then the magnetic body is cut in a predetermined dimension.

11. The transformer core manufacturing method according to claim 5, wherein a predetermined slackness is added to each of a plurality of magnetic bodies uncoiled from the plurality of uncoilers through urging.

12. The transformer core manufacturing method according to claim 5, wherein the magnetic bodies uncoiled from the respective uncoilers are guided independently so as not to be in contact with each other.

13. A transformer core manufacturing apparatus for manufacturing a transformer core having thin plates formed of magnetic materials laminated, comprising:

an uncoiler unit to uncoil the magnetic material;

a carrier unit for guiding a plurality of the magnetic materials uncoiled from the plurality of the uncoilers as a single group of magnetic body;

a first alignment unit for aligning the carried group of the single magnetic body in a width direction;

a cut-off unit for cutting the magnetic body aligned by the first alignment unit in a predetermined dimension;

a laminating unit for laminating a plurality of the groups of the magnetic body cut by the cut-off unit;

a second alignment unit for aligning the magnetic body laminated on the laminating unit; and a control unit for controlling operations of the uncoiler unit, the carrier unit, the first alignment unit, the cut-off unit, the laminating unit, and the second alignment unit, wherein:

the laminating unit includes:

a laminating stand on which the magnetic body is laminated;

a clamp mechanism for pressing the intermediate portion of the magnetic body against the laminating stand;

a guide tray formed of two side units apart from a center, disposed in a vertical direction between the laminating stand and the clamp mechanism and disposed in horizontal and width directions face to face with the laminating stand and the clamp mechanism; and a moving mechanism for reciprocating the laminating stand in a carried direction of the magnetic body, and the second alignment unit is provided with an alignment mechanism for aligning an upper layer of the magnetic body laminated on the laminating stand with the magnetic body as the lower layer with respect to the width direction.

14. A transformer core manufacturing method for manufacturing a transformer core having thin plates formed of magnetic materials laminated, comprising the steps of:

an uncoiling step of uncoiling a magnetic body from a plurality of uncoilers;

a first aligning step of aligning the uncoiled magnetic body from the uncoiler in a width direction which is about perpendicular to the carried direction of the magnetic body;

a cutting step of cutting the aligned magnetic body on a guide tray;

a laminating step of laminating the magnetic body which have been cut on a laminating stand; and a second aligning step of aligning the laminated magnetic body in the width direction, wherein:

the laminating step includes:

a clamping step of clamping the intermediate portion of the magnetic body by the laminating stand and a clamp mechanism; and a releasing step of releasing the guide tray supporting the magnetic body, and in the second aligning step, an upper layer of the laminated magnetic body is aligned with the magnetic body as the lower layer with respect to the width direction.

* * * * *